US012716682B1

(12) United States Patent
Maschin

(10) Patent No.: US 12,716,682 B1
(45) Date of Patent: Aug. 25, 2026

(54) GEL LAUCHING APPARATUS WITH HYDROCHROMIC MATERIAL AND POROUS PLASTIC

(71) Applicant: Hasbro, Inc., Pawtucket, RI (US)

(72) Inventor: Robert C Maschin, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 3 days.

(21) Appl. No.: 18/928,088

(22) Filed: Oct. 27, 2024

Related U.S. Application Data

(60) Provisional application No. 63/593,333, filed on Oct. 26, 2023.

(51) Int. Cl.

| | |
|---|---|
| ***F41B 11/89*** | (2013.01) |
| ***F41A 31/02*** | (2006.01) |
| ***F41B 11/52*** | (2013.01) |
| ***F41B 11/60*** | (2013.01) |
| ***F41B 11/73*** | (2013.01) |
| *F41A 21/08* | (2006.01) |
| *F42B 6/10* | (2006.01) |

(52) U.S. Cl.
CPC ..... *F41B 11/89* (2013.01); *F41A 31/02* (2013.01); *F41B 11/52* (2013.01); *F41B 11/60* (2013.01); *F41B 11/73* (2013.01); *F41A 21/08* (2013.01); *F42B 6/10* (2013.01)

(58) Field of Classification Search
CPC ..... F41B 11/60; F41B 11/52; F41A 31/02
USPC ..... 124/56
See application file for complete search history.

(56) References Cited

U.S. PATENT DOCUMENTS

| | | | |
|---|---|---|---|
| 46,617 | A | 3/1865 | Allen |
| 159,609 | A | 2/1875 | Prescott |
| 956,760 | A | 5/1910 | Moulin |
| 1,441,975 | A | 1/1923 | Edelin |
| 1,488,995 | A | 4/1924 | McCollom |
| 1,743,576 | A | 1/1930 | Smith |
| 1,873,677 | A | 8/1932 | Traver |
| 2,214,224 | A | 9/1940 | Douglas |
| 2,483,752 | A | 10/1949 | Buhl |
| 2,634,717 | A | 4/1953 | Junkin |
| 2,725,868 | A | 12/1955 | Foster |
| 2,737,942 | A | 3/1956 | Horowitz et al. |
| 3,054,536 | A | 9/1962 | Sagarin |
| 3,262,440 | A | 7/1966 | Kuhn |
| 3,385,279 | A | 5/1968 | Pitcher |
| 3,420,133 | A | 1/1969 | Proll |
| 3,584,614 | A | 6/1971 | Horvath |
| 3,847,132 | A | 11/1974 | Schatz |
| 3,990,426 | A | 11/1976 | Stokes |
| 4,094,294 | A | 6/1978 | Speer |
| 4,345,578 | A | 8/1982 | Speer |
| 4,597,527 | A | 7/1986 | Sands |
| 4,774,929 | A | 10/1988 | Millman |
| 4,841,945 | A | 6/1989 | Braden |

(Continued)

*Primary Examiner* — John Cooper
(74) *Attorney, Agent, or Firm* — Perry Hoffman

(57) ABSTRACT

A toy launching apparatus for hydrated super absorbent projectiles having a barrel and/or a barrel extender using porous plastic and coated with hydrochromic material where the hydrated super absorbent projectiles and the interior surface of the barrel and/or of the barrel extender are tight fitting. Launcher apparatus and methods are provided with toy projectile launching rounds expelled from an air compression source extending to position received projectiles launched through a barrel.

20 Claims, 7 Drawing Sheets

(56) References Cited

U.S. PATENT DOCUMENTS 4,890,404 A 1/1990 Ferri
5,205,271 A 4/1993 Salva
5,244,153 A 9/1993 Kuhn et al.
5,267,549 A 12/1993 Webber
5,343,850 A 9/1994 Steer
5,471,967 A 12/1995 Matsuzaki et al.
5,529,050 A 6/1996 D'Andrade
5,535,729 A 7/1996 Griffin et al.
5,704,150 A 1/1998 Millman
5,878,734 A 3/1999 Johnson et al.
6,119,671 A 9/2000 Smith et al.
6,460,530 B1 10/2002 Backeris et al.
6,488,019 B2 12/2002 Kotsiopoulos
6,590,386 B1 * 7/2003 Williams ..... F41A 19/01 124/71
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,360,042 B2 * 1/2013 Skilling ..... F41B 11/70 124/71
8,371,282 B2 2/2013 Meggs et al.
8,397,705 B2 3/2013 DeHaan et al.
8,567,378 B2 10/2013 Nugent
8,640,683 B2 2/2014 Meggs et al.
8,695,579 B2 4/2014 Huebl
8,875,688 B2 11/2014 Nugent
9,097,476 B2 8/2015 Mead et al.
9,097,477 B1 8/2015 Mead et al.
9,389,042 B1 7/2016 Clayton
9,500,436 B2 11/2016 Macy
9,958,230 B1 5/2018 Nugent et al.
10,488,143 B2 11/2019 Victor et al.
10,488,148 B2 11/2019 Johnson et al.
10,823,527 B2 11/2020 Tino et al.
10,876,809 B1 12/2020 Kopman et al.
10,907,929 B2 2/2021 Bernal
2002/0166551 A1 11/2002 Lee
2003/0034020 A1 * 2/2003 Irizarry ..... F41B 11/00 124/56
2007/0034197 A1 2/2007 Tschech
2008/0245351 A1 * 10/2008 Kaakkola ..... F41B 11/721 124/73
2009/0095272 A1 4/2009 Zimmerman
2009/0145412 A1 6/2009 Barish
2010/0154766 A1 * 6/2010 Skilling ..... F41B 11/71 124/71
2010/0206281 A1 8/2010 Kanitz et al.
2010/0258101 A1 * 10/2010 Campo ..... F41B 11/57 124/51.1
2013/0112184 A1 5/2013 Corsiglia et al.
2013/0146043 A1 6/2013 Zarecky et al.
2013/0312722 A1 11/2013 Price
2016/0018184 A1 1/2016 Park
2021/0381796 A1 * 12/2021 Buys ..... F41A 9/68

* cited by examiner

GEL LAUCHING APPARATUS WITH HYDROCHROMIC MATERIAL AND POROUS PLASTIC

FIELD OF THE INVENTION

The present invention relates generally to toy blaster apparatus and methods for a toy projectile launcher discharging projectiles such as foam rounds, balls, and flexible projectiles including hydrated super absorbent polymer (SAP) beads for discharging plural projectile rounds through a launch barrel in a novel fashion. More particularly, toy launching apparatus are disclosed that discharges super absorbent polymer projectiles and includes hydrochromic material on the apparatus that changes color when exposed to moisture, or with the use of porous plastic which may be used with a compressed air source for causing compressed air to expel through the channel into the receptacle and outwardly launch the one or more of the received projectile rounds through the passage and the launching barrel.

BACKGROUND OF THE INVENTION

Toy gel launching apparatus are known to include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

US 2008/0078368 to Taylor entitled Balanced, Disguised, Non-Clogging Paintball Gun Hopper with Optional Level, published in 2008, purports to disclose a paintball gun hopper in the form of a scope adapted to achieve and maintain the balance of the paintball gun to which the hopper is mounted. It is mentioned that the material of the hopper may also have a thermochromic additive to change its color as a function of temperature, a photochromic additive to change color when the gun is exposed to sunlight, and a phosphorescent polymer additive to have the gun or a part thereof glow in the dark.

U.S. Pat. No. 10,228,221 to Shurman et al. entitled System, Method and Apparatus For Toy and Games for Water Guns, issued in 2019, purports to disclose a target having a magnet and an element attached to the magnet, the element having a hydrochromic ink that goes from a first color to a second color when "moistened" by water. U.S. Pat. No. 11,642,606 to Sleman entitled Hydrochromic Building Elements and Method of Use, issued in 2023, purports to use a hydrochromic stimulus to one of two or more toy building elements that changes color when exposed to water. At column 4, line 1, the exposure is broadened to "liquid or moisture." At column 1, line 48, the stimulus may change color when exposed to heat. The patent also may use a stimulus to ensure proper assembly of the toy building elements. At column 4, line 20, the stimulus may be a photochromic ink which reacts to UV and/or sunlight. At column 3, beginning at line 60, the toy "may have an outermost transitionable layer that undergone change, alteration, or transformation, visible or invisible to the user, upon the application of an external stimulus or a passage of time."

US 2008/0078368 to Taylor entitled Balanced, Disguised, Non-Clogging Paintball Gun Hopper with Optional Level, published in 2008, purports to disclose a paintball gun hopper in the form of a scope adapted to achieve and maintain the balance of the paintball gun to which the hopper is mounted. It is mentioned that the material of the hopper may also have a thermochromic additive to change its color as a function of temperature, a photochromic additive to change color when the gun is exposed to sunlight, and a phosphorescent polymer additive to have the gun or a part thereof glow in the dark. U.S. Pat. No. 10,352,641 to Herrera et al. entitled Gun Barrel Thermal Indicator, issued in 2019, purports to use a thermogenic compound to indicate the temperature of a gun barrel during and after use. U.S. Pat. No. 11,619,462 to Herrera et al. entitled Gun Temperature Identification System and Method of Use Thereof, issued in 2023, purports to cover the same product as the '641 patent.

In addition to earlier patents, toys are known where the outside of the toy may be hydrophobic with the inside being hydrophilic providing color changing toys with materials covered with hydrochromic ink, another examples including thermochromic ink, or photochromic ink. Other examples may include color changing hydrochromic or thermochromic paint. However, it is noted that none of the known prior art disclose the use of porous plastic and hydrochromic material for a toy launching apparatus.

SUMMARY OF THE INVENTION

The inventive toy launching apparatus includes a housing, a dispensing compartment for storing and dispensing hydrated super absorbent polymer projectiles, the dispensing compartment being operatively connected to the housing, a discharge mechanism mounted to the housing and operatively connected to the dispensing compartment, a hydrochromic material operatively connected to the discharge mechanism, an energy source mounted within the housing for causing hydrated projectiles to be ejected from the discharge mechanism, and a trigger mechanism mounted to the housing for actuating the energy source.

The present invention also relates to a method for assembling the toy launching apparatus including the steps of providing a housing, providing a dispensing compartment for storing and dispensing hydrated super absorbent polymer projectiles, operatively connecting the dispensing compartment to the housing, providing a discharge mechanism, operatively connecting the discharging mechanism to the dispensing compartment, providing a hydrochromic material, operatively connecting the hydrochromic material to the discharge mechanism, providing an energy source, mounting the energy source to the housing, operatively connecting the energy source to the housing for launching hydrated super absorbent polymer projectiles, and mounting a trigger mechanism to the housing for actuating the energy source.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
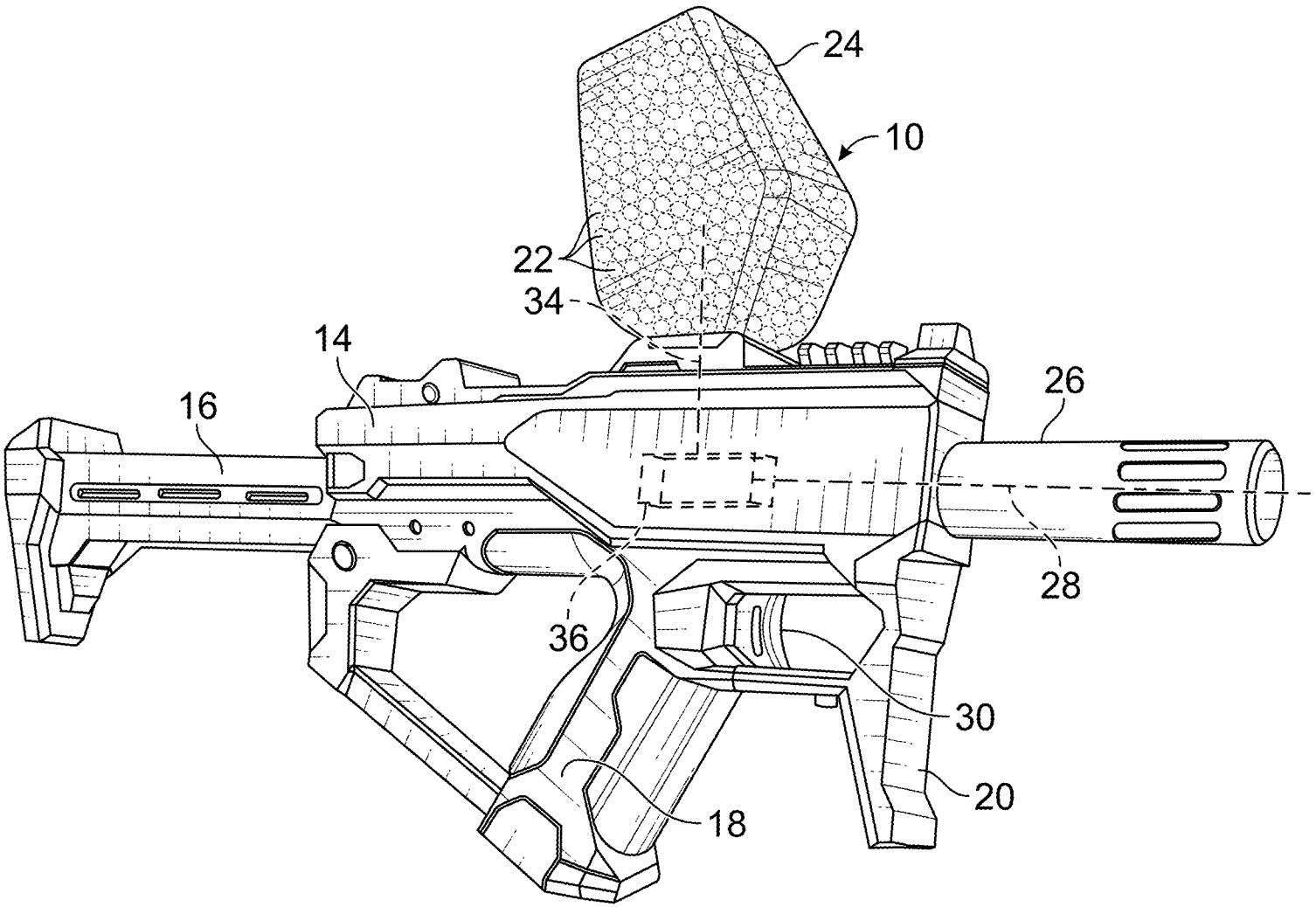
FIG. 1 is an isometric view of the inventive toy launching apparatus in a simulated rifle form.
Figure 2:
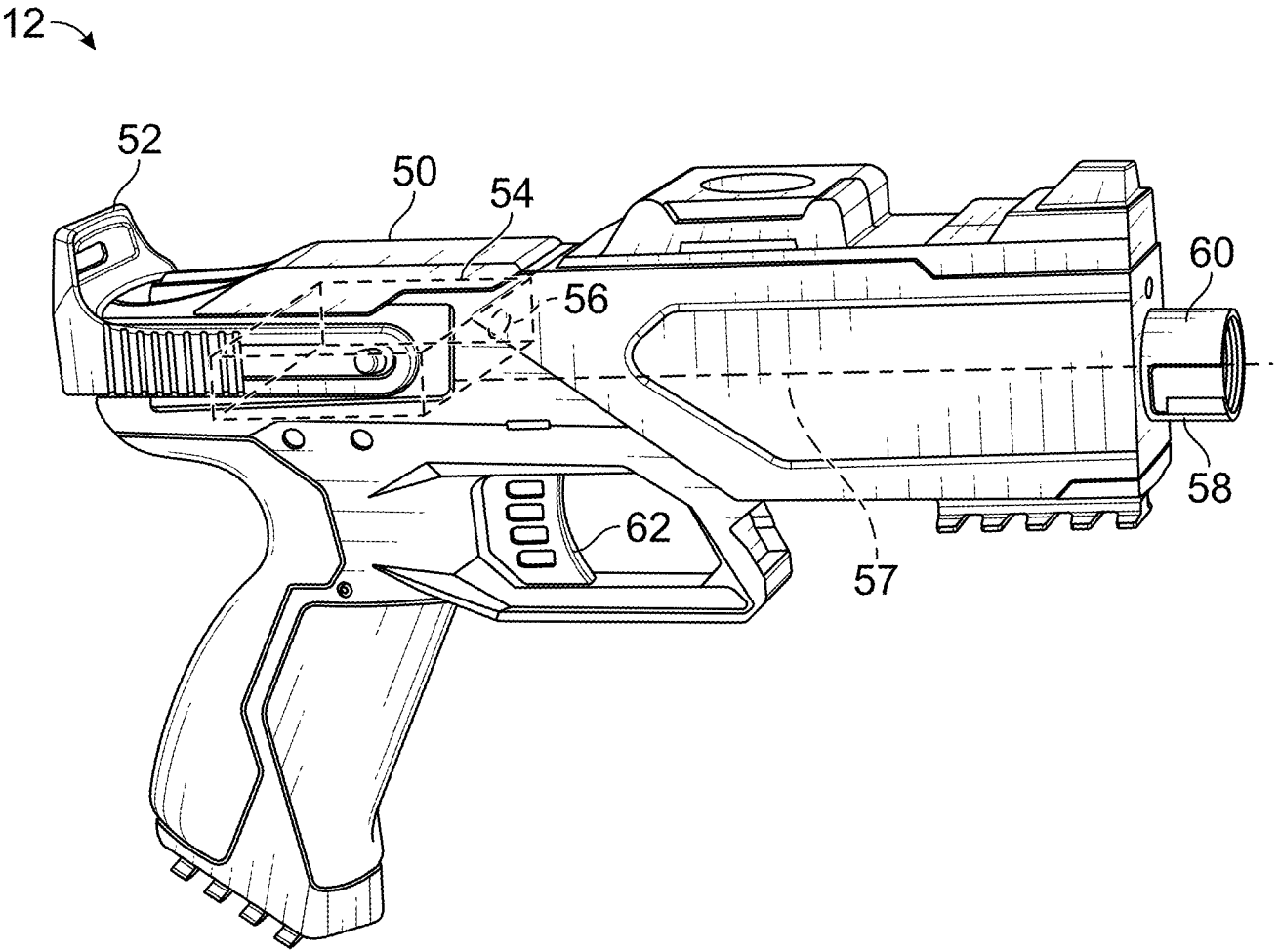
FIG. 2 is an isometric view of the inventive toy launching apparatus in a simulated gun form.

Referring to FIGS. 1 and 2, there are shown two variations of the inventive toy launching apparatus. In FIG. 1, the toy launching apparatus simulates a rifle 10, and in FIG. 2, a handgun 12 is simulated, with toy launching apparatus being able to discharge small projectiles that are commonly about six to eight mm in diameter and are made of superabsorbent polymer, most commonly sodium polyacrylate. These projectiles are variously referred to as gel beads, water beads, hydrogel balls, gel balls, water bullets or simply gels. Toy launching apparatus that discharge these gel bead projectiles provide a great deal of play value because they have the rather unique characteristic of bursting on impact with a target, another player for example, and then after a short time disappearing completely without stain or residue.

The simulated rifle 10, FIG. 1, includes a housing 14, an extendible stock 16, a grip 18 and a handle 20. The toy rifle 10 also includes a dispensing compartment for storing and dispensing the hydrated gel bead projectiles 22 in the form of an external hopper 24 once the gel beads are first hydrated. The gel beads may be launched through a discharge mechanism in the form of a barrel 26. A unique feature of the toy rifle 10 is that a hydrochromic material, which may appear in the form of hydrochromic ink 28, may be applied to the outer surface of the barrel 26. As explained below, the hydrochromic material has the ability to change color or transition from a color to a translucent layer in the presence of moisture thereby offering one appearance before play and another appearance during play. An energy source may be mounted within the housing 14 where the energy source may include a cylinder, a piston and a launch spring. The energy source may be energized by one or more batteries in the grip 18, or manually by a user, through a trigger mechanism 30 or by a cocking handle. The dispensing compartment is operatively connected to the housing, a discharge mechanism mounted to the housing and operatively connected to the dispensing compartment, a hydrochromic material operatively connected to the discharge mechanism, an energy source mounted within the housing for causing hydrated projectiles to be ejected from the discharge mechanism. A launch housing may be provided in mechanical communication with a receptacle allowing one or more of the projectile rounds to be received into the launch housing for discharging hydrated projectile rounds. The projectile rounds launching barrel may include a proximal end, a distal end, an interior bore therethrough, and an exterior surface thereof, the proximal end of the projectile rounds launching barrel being mounted to the launch housing. A passage from the receptacle at the interior bore of the projectile rounds launching barrel is enabled to position the one or more received projectiles in the passage with a compressed air source with a channel into the receptacle for the compressed air source. An indicator at the exterior surface of the projectile rounds launching barrel for indicating a status of the passage at the interior bore of the projectile rounds launching barrel, and an actuator at the launch housing is linked with the compressed air source for causing compressed air to expel through the channel into the receptacle and outwardly launch the one or more of the received projectile rounds through the passage and the launching barrel, using a trigger mechanism mounted to the housing for actuating the energy source.

The hopper 24 may be operatively connected to the housing 14 by a threaded connector or any other suitable connection that allows the gel beads 22 to move from the hopper 24 by gravity along an internal passageway 34 to a launch chamber 36 (both symbolized by dotted lines) before being discharged through the barrel 26. There may be a gate in the passageway that is moved by the trigger mechanism 30 when the user of the toy launching apparatus wishes to cause a discharge of more than one gel bead projectile. In the alternative, other known mechanisms may be used to operatively connect the gel beads in the hopper, or in another receptacle, to the barrel, as for example, the mechanism disclosed below in relation to the toy handgun 12. Also in the alternative, other energy sources now known or developed in the future may be used.

The toy launching apparatus in the form of the simulated handgun 12, FIG. 2, includes a housing 50 with a cocking handle 52, a dispensing compartment in the form of an internal receptacle 54 for storing and dispensing hydrated gel bead projectiles 56, the receptacle 54 being mounted within the housing 50 (symbolized by a cuboid drawn in dotted line), to a launch chamber 57 and then to a discharge mechanism in the form of a barrel 58, and a hydrochromic material in the form of hydrochromic ink 60 placed on the outer surface of the barrel 58. The projectile launching barrel 58 with the discharge mechanism at the housing has its interior bore therein, with an indicator at an exterior surface thereof, such that the interior bore projectile launching barrel enables positioning of received projectiles 56 in the passage. Thus the hydrochromic material operates to indicate a status of the passage at the interior bore of the projectile rounds launching barrel at the exterior surface. Like the toy launching device 10, an energy source may be mounted in or to the housing 50, such as a cylinder, a piston and a launch spring connected to the cocking handle 52 and activated by a trigger mechanism 62, or the launch spring may be operated directly by the trigger mechanism. It is noted that the energy source may be any one of those disclosed in the abovementioned U.S. Pat. Nos. 8,371,282 and 8,640,683 which are incorporated herein by reference.

The hydrated gel bead projectiles in the receptacle may be operatively connected to the barrel by dropping into a chute and moving into a launching chamber where the projectiles are then launched by compressed air.

As used here, hydrochromic materials are an innovative type of material that changes color when exposed to water or moisture. The hydrochromic material operates with the projectile launching barrel at the housing, with the projectile launching barrel having interior bore therein, and an indicator at an exterior surface of the housing, said interior bore projectile launching barrel enabled to position the one or more received projectiles in the passage with the hydrochromic material operating to indicate a status of the passage at the interior bore of the projectile rounds launching barrel. For example, the material may change from the color white to a translucent color, for example, to allow an image initially hidden on the barrel to be exposed or reveal itself, but only after the hydrochromic material is moistened or dampened. This advantageous effect is able to reverse itself once the material dries. Hydrochromic materials may appear as ink, a film, and as paint or any other convenient form now available or created in the future. The coating, paint, or layer material may impregnate the launching barrel, or may be connected operatively connected the discharge mechanism as alternative configurations.

Figure 3:
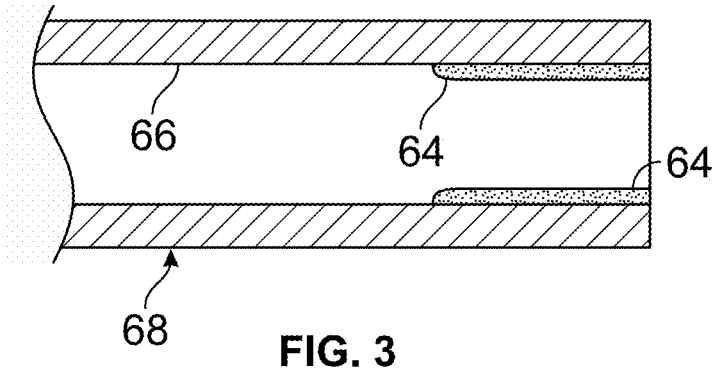
FIG. 3 is a sectional view of a barrel portion of the toy launching apparatus illustrating an interior surface coated with moisture.
Figure 4:
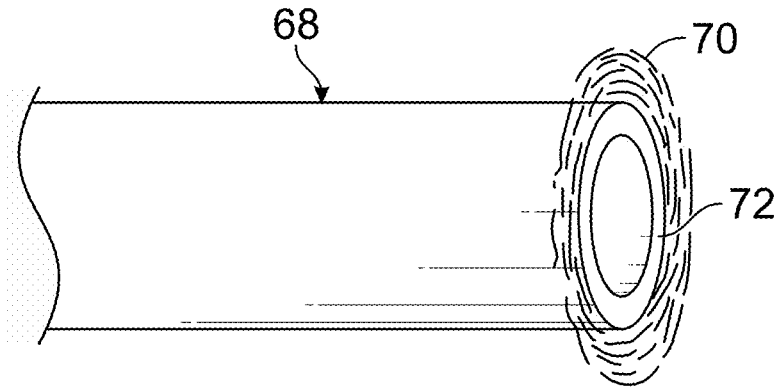
FIG. 4 is an isometric view of the barrel portion of the toy launching apparatus illustrating an ambient mist of moisture.

To take advantage of the hydrochromic material, it has been found that when using hydrated gel bead projectiles, moisture adheres to the outside of the projectiles as a result of first soaking the gel beads in water to cause them to expand. Further, moisture appears during the loading process, namely, the process of moving wet gel beads to the hopper or other receptacle. Finally, moisture appears from some gel beads breaking in the barrel during launch as will be disclosed below. Thus, as hydrated gel beads move through the internal passageways and the barrel a fair amount of moisture is deposited within and around the barrel as shown in FIGS. 3 and 4. In FIG. 3, moisture 64 is shown coated on the internal surface passage 66 of a barrel 68, and in FIG. 4, a water mist 70 is shown clustered around the distal end 72 of the barrel 68.

Figure 5:
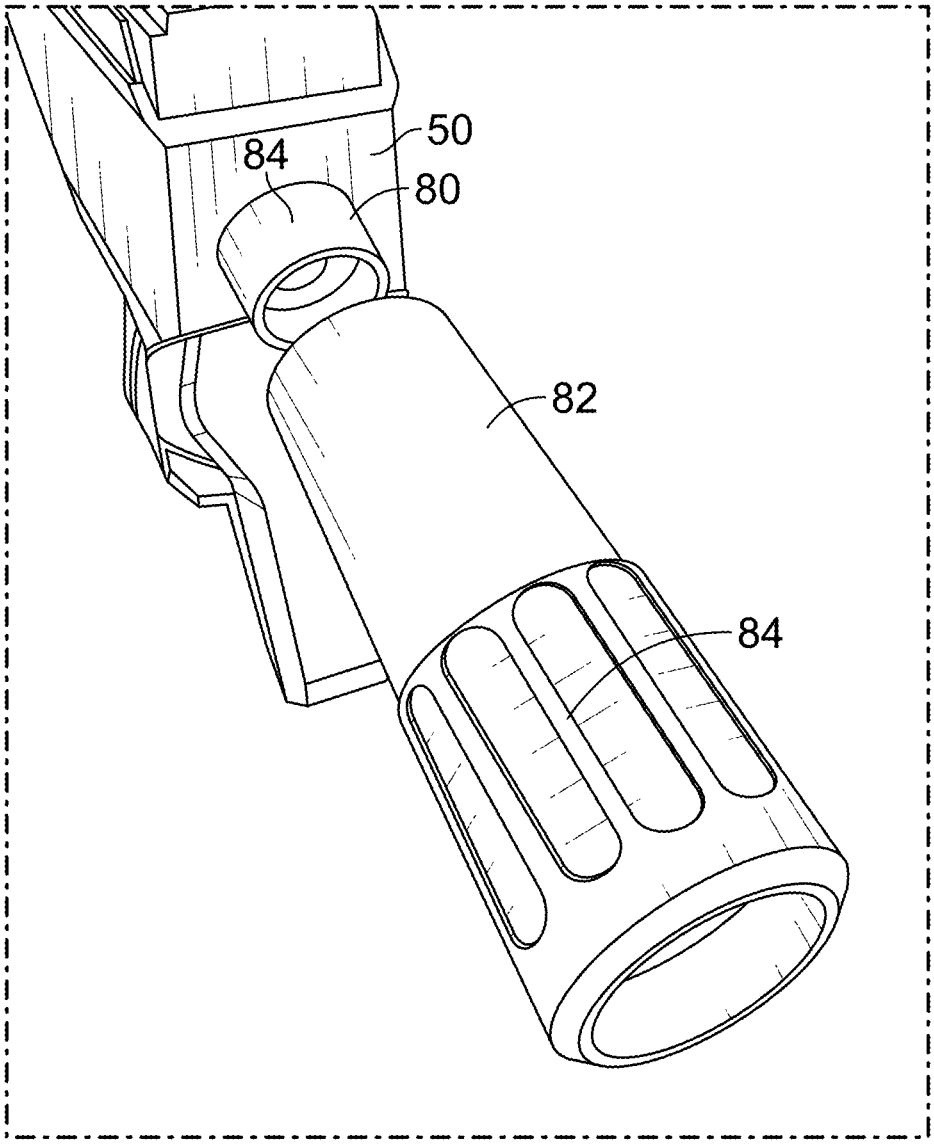
FIG. 5 is an exploded isometric view of a barrel and a barrel extender.

To utilize the ambient moisture created by a toy launching apparatus firing gel beads, a barrel 80 and/or a barrel extender 82, FIG. 5, is formed of porous plastic. Porous plastic allows the moisture to move from inside the barrel and/or barrel extender to the outer surface where it may contact the hydrochromic material 84 coating the outer surface of the barrel 80 and/or the extender 82. The porosity of the barrel enables moisture to migrate through the thickness of the barrel material to reach the hydrochromic layer so as to wet that layer from its point where it contacts from within the barrel away from the center line of the barrel, as well as through a lubricious quality of below discussed gel beads rupturing, releasing water which lubricates the interior of the barrel and/or barrel extender porosity, enabling moisture in the barrel to migrate to the outside of the barrel via ejection as the round is expelled through the distal end of the barrel. The moisture may also be allowed to migrate through the thickness of material from inside to outside through use of moisture wicking action. The enhanced play value here is that a color and/or design and/or message appearing on the barrel and/or the barrel extender may be invisible before use of the toy launching apparatus and yet may appear after play has started because the hydrochromic material may change from a some opaque color to a translucent color thus allowing the color and/or design and/or message of the barrel/barrel extender to become visible. If the barrel/barrel extender is colored red, the toy launching apparatus may appear to be heating as a real weapon would in operation. Or, the barrel/barrel extender may have an artistic design, which only appears once play begins. Or, a trademark logo may be placed on the barrel/barrel extender that appears only after play begins and as the hydrochromic material is moistened.

For purposes here, 'porous plastic' may be defined as a breathable, versatile material that is used in a lot of different products. Fusing plastic particles together to create a breathable microporous structure may form porous plastic. The result is a durable, design-flexible component that can control the flow of gases, liquids, light, or sound. It's probably best understood by considering a few examples. Foam applicators used to apply makeup are made of porous plastic, as are the wicks inside plug-in air fresheners and the nibs on highlighters used to apply ink. In all cases, the end product requires a high level of control over the flow of gas and liquids.

There are three main types of porous plastics: 'sintered porous plastic' are various polymers or particles fused to create controlled pore sizes, which creates a strong, self-supporting material; 'bonded fibers' create materials with a wide range of fluid transfer abilities that are appropriate for medical, industrial, and consumer products; and 'open-cell foam' is a customized blend of materials with varying pore size, densities and softness. The open-cell form is commonly used as medical grade and cosmetic foam to absorb fluid.

Standard porous plastic materials are: Ultra High Molecular Weight Polyethylene (UHMWPE); High Density Polyethylene (HDPE); Low Density Polyethylene (LDPE); Very Low Density Polyethylene (VLDPE); Polypropylene (PP); Ethylene Vinyl Acetate (EVA); Polystyrene (PS); Epoxy Glass; and Phenol Glass.

Figure 6:
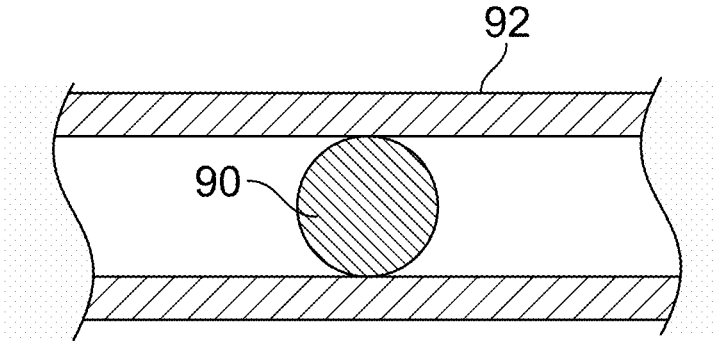
FIG. 6 is a sectional view of a barrel portion and a tight fitting hydrated super absorbent polymer projectile.
Figure 7:
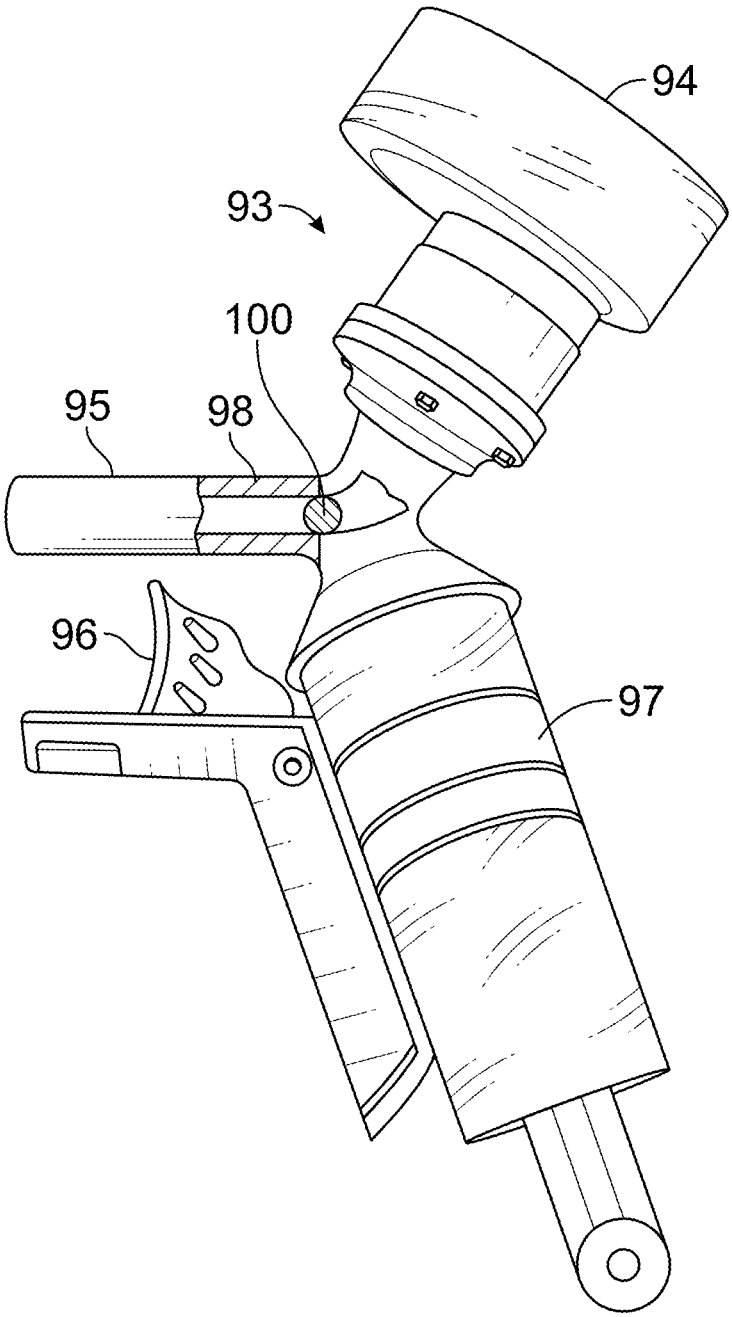
FIG. 7 is an elevational view of another embodiment of a toy launching apparatus with a stepped barrel portion and a tight fitting hydrated super absorbent polymer projectile.

To ensure that at least some gel beads break apart in the barrel and/or the barrel extender during operation, reference is made to FIGS. 6 and 7, where a gel bead 90 is tightly fitted in the barrel and/or barrel extender 92. A rupture of the gel beads is more likely to occur at the beginning of play when the inner surface of the barrel and/or of the barrel extender is dry. Once some of the gel beads rupture the released water lubricates the interior of the barrel and/or barrel extender and the gel beads are less likely to break apart in the toy launching apparatus.

An alternative barrel design to cause rupture of the gel beads is shown in FIG. 7, featuring another toy launching apparatus embodiment 93 that includes a hopper 94, a barrel 95, a trigger 96 and an energy source 97. The barrel 95 includes a step 98 in the barrel interior causing a first group of launching gel beads, represented by the gel bead 100 to rupture. After the rupture of this first group of gel beads, enough lubrication is available to ease later launched groups of gel beads to squeeze through the barrel.

Figure 8:
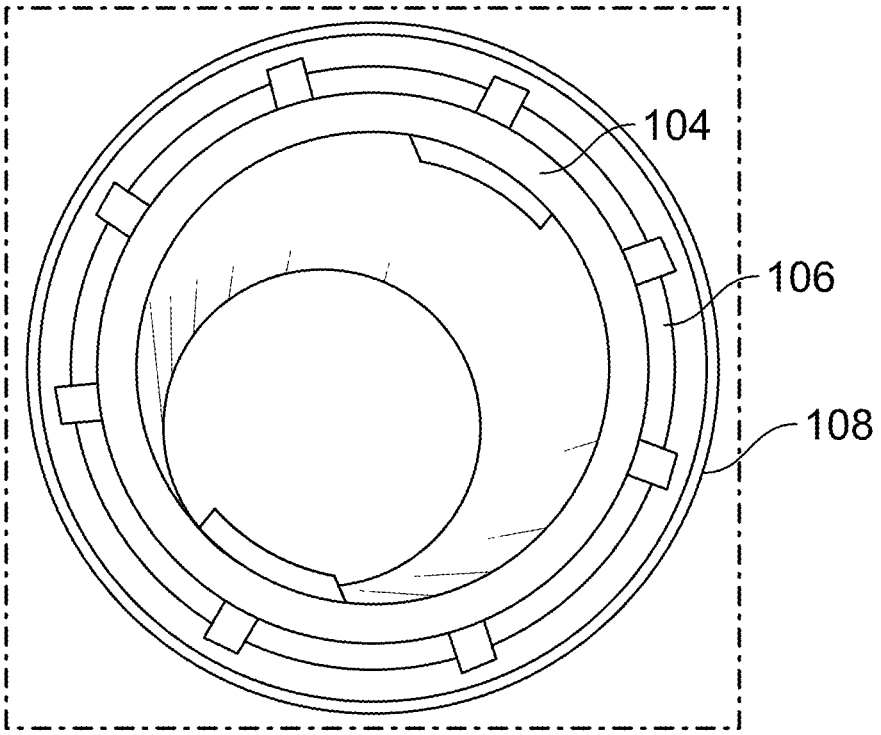
FIG. 8 is an isometric view of a barrel or barrel extender illustrating an inner barrel tube of porous plastic, a gap and an outer tube of hydrochromic material.

Another alternative barrel and/or barrel extender variation is illustrated in FIG. 8, where there is an inner barrel tube 104 of porous plastic, a gap or space, and an outer barrel tube 108 of hydrochromic material. The moisture may also be allowed to migrate from inside to outside through use of moisture wicking action.

Figure 9:
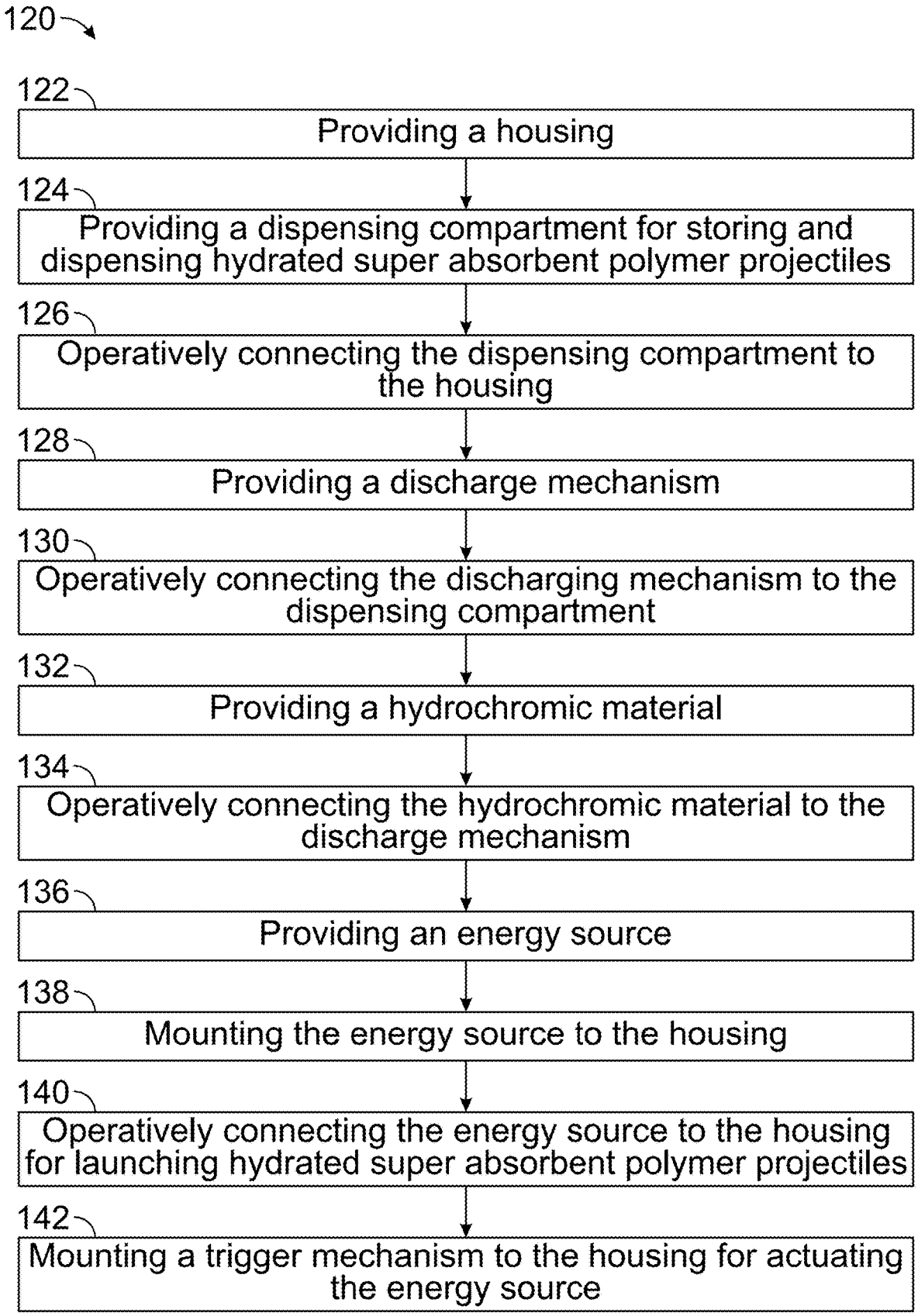
FIG. 9 is a flow diagram of a method for assembling a toy launching apparatus.

The present invention includes a method 120, FIG. 9, for assembling a toy launching apparatus including the steps of providing a housing 122, providing a dispensing compartment for storing and dispensing hydrated super absorbent polymer projectiles 124, operatively connecting the dispensing compartment to the housing 126, providing a discharge mechanism 128, operatively connecting the discharging mechanism to the dispensing compartment 130, providing a hydrochromic material 132, operatively connecting the hydrochromic material to the discharge mechanism 134, providing an energy source 136, mounting the energy source to the housing 138, operatively connecting the energy source to the housing for launching hydrated super absorbent polymer projectiles 140, and mounting a trigger mechanism to the housing for actuating the energy source 142.

From the foregoing, it can be seen that there has been provided a detailed description of features for an improved toy launching apparatus as well as a disclosure of a method for making the toy launching apparatus. While particular embodiments of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims and features when viewed in their proper perspective based on the prior art.

What is claimed is:

1. A toy launching apparatus comprising:

a housing;

a dispensing compartment for storing and dispensing hydrated super absorbent polymer projectiles, the dispensing compartment being operatively connected to the housing;

a passage from the dispensing compartment;

a discharge mechanism mounted to the housing and operatively connected to the dispensing compartment;

a hydrochromic material operatively connected to the discharge mechanism for indicating a status of the passage;

an energy source mounted within the housing for causing hydrated projectiles to be ejected from the discharge mechanism; and a trigger mechanism mounted to the housing for actuating the energy source.

2. The toy launching apparatus of claim 1, wherein the discharge mechanism comprises a projectile launching barrel at the housing, with the projectile launching barrel of the discharge mechanism with the housing having interior bore therein, and an indicator at an exterior surface thereof, said interior bore projectile launching barrel enabled to position the one or more received projectiles in the passage with the hydrochromic material operating to indicate a status of the passage at the interior bore of the projectile rounds launching barrel at said exterior surface.

3. A toy launching apparatus, comprising:

a launch housing for discharging hydrated projectile rounds;

a receptacle allowing one or more of the projectile rounds to be received into the launch housing;

a projectile rounds launching barrel including a proximal end, a distal end, an interior bore therethrough, and an exterior surface thereof, the proximal end of the projectile rounds launching barrel being mounted to the launch housing;

a passage from the receptacle at the interior bore of the projectile rounds launching barrel enabled to position the one or more received projectiles in the passage; and an indicator for indicating a status of the passage at the interior bore of the projectile rounds launching barrel, wherein the indicator is a hydrochromic indicator at the exterior surface of the projectile rounds launching barrel.

4. The toy launching apparatus of claim 3, further comprising:

a compressed air source with a channel into the receptacle for the compressed air source; and an actuator at the launch housing and linked with the compressed air source for causing compressed air to expel through the channel into the receptacle and outwardly launch the one or more of the received projectile rounds through the passage and the launching barrel, wherein the hydrated projectile rounds are capable of being ruptured.

5. The toy launching apparatus of claim 3, wherein the hydrated projectile rounds are hydrated super absorbent polymer projectile rounds capable of being ruptured.

6. The toy launching apparatus of claim 3, wherein the passage is at the proximal end of the projectile rounds launching barrel at the interior bore thereof.

7. The toy launching apparatus of claim 3, wherein the passage extends into the interior bore of the projectile rounds launching barrel in the proximal end thereof.

8. The toy launching apparatus of claim 3, wherein the passage is an inner diameter step in the interior bore of the projectile rounds launching barrel in the proximal end thereof.

9. The toy launching apparatus of claim 3, wherein the passage extends inside and throughout the interior bore of the projectile rounds launching barrel from the proximal end to the distal end thereof.

10. The toy launching apparatus of claim 3, wherein the one or more received projectiles positioned in the passage of the projectile rounds launching barrel forms a frictional interference seal between the one or more received projectiles and the passage.

11. The toy launching apparatus of claim 3, wherein the one or more received projectiles positioned in the passage of the projectile rounds launching barrel forms a frictional interference seal between the one or more received projectiles and throughout the interior bore thereof.

12. The toy launching apparatus of claim 3, wherein the indicator at the exterior surface of the projectile rounds launching barrel is a hydrochromic indicator responsive to a vapor or mist generated about the outside of the projectile rounds launching barrel with a pre-determined number of the hydrated projectile rounds being ruptured therein indicating a ready status to properly outwardly launch the one or more of the received projectile rounds through the interior bore of the launching barrel.

13. The toy launching apparatus of claim 3, wherein the hydrochromic indicator indicates a moisture status of the passage or the interior bore of the projectile rounds launching barrel.

14. The toy launching apparatus of claim 3, wherein the indicator at the exterior surface of the projectile rounds launching barrel is a hydrochromic film or paint.

15. The toy launching apparatus of claim 3, wherein the indicator at the exterior surface of the projectile rounds launching barrel is a hydrochromic film or paint, concealing or revealing a color of the projectile rounds launching barrel.

16. The toy launching apparatus of claim 3, wherein the indicator at the exterior surface of the projectile rounds launching barrel is a hydrochromic material thereof for changing a color of the projectile rounds launching barrel.

17. The toy launching apparatus of claim 3, wherein the indicator at the exterior surface of the projectile rounds launching barrel is a hydrochromic material thereof for changing a color of the projectile rounds launching barrel to the color red.

18. The toy launching apparatus of claim 3, wherein the indicator at the exterior surface of the projectile rounds launching barrel is a hydrochromic indicator for a moisture status of the interior bore of the projectile rounds launching barrel with the hydrated projectile rounds being ruptured therein for a ready status to properly outwardly launch the one or more of the received projectile rounds through the launching barrel.

19. The toy launching apparatus of claim 3, wherein the receptacle comprises a mechanical interface to a hopper or a magazine.

20. A method for assembling a toy launching apparatus comprising the steps of:

providing a launch housing;

providing a dispensing compartment for storing and dispensing hydrated projectile rounds;

operatively connecting the dispensing compartment to the housing;

providing a discharge mechanism;

operatively connecting the discharging mechanism to the dispensing compartment with a projectile rounds launching barrel having a proximal end mounted to a launch housing, with the projectile rounds launching barrel having interior bore therein with a passage from the interior bore of the projectile rounds launching barrel enabled to position the projectile rounds in the passage;

providing a hydrochromic material;

operatively connecting the hydrochromic material as an exterior indicator of the passage with the hydrochromic material operating to indicate a status of the passage at the interior bore of the projectile rounds launching barrel;

providing an energy source;

mounting the energy source to the housing;

operatively connecting the energy source to the housing for launching hydrated projectile rounds; and mounting a trigger mechanism to the housing for actuating the energy source.

* * * * *